US007259318B2

(12) United States Patent
Chiliachki

(10) Patent No.: US 7,259,318 B2
(45) Date of Patent: Aug. 21, 2007

(54) MAGNETIC PICKUP DEVICE FOR A STRINGED MUSICAL INSTRUMENT WITH LARGE FREE SHAPE LOW IMPEDANCE COIL FOR NOISE CANCELATION

(75) Inventor: Ilitch S Chiliachki, Santa Barbara, CA (US)

(73) Assignee: Ilitch S. Chiliachki, Camarillo, CA (US)

( * ) Notice: Subject to any disclaimer, the term of this patent is extended or adjusted under 35 U.S.C. 154(b) by 207 days.

(21) Appl. No.: 10/906,965

(22) Filed: Mar. 14, 2005

(65) Prior Publication Data

US 2005/0204905 A1 Sep. 22, 2005

Related U.S. Application Data

(60) Provisional application No. 60/521,231, filed on Mar. 16, 2004.

(51) Int. Cl.
*G10H 3/14* (2006.01)

(52) U.S. Cl. ..... 84/728; 84/290; 84/294

(58) Field of Classification Search ..... 84/290, 84/294, 453, 728
See application file for complete search history.

(56) References Cited

U.S. PATENT DOCUMENTS 1,707,115 A * 3/1929 Dierdorf ..... 84/723
2,089,171 A * 8/1937 Beauchamp ..... 84/726
2,508,783 A * 5/1950 Cornwell et al. ..... 369/149
3,077,522 A * 2/1963 Gunter, Jr. et al. ..... 369/136
3,356,795 A * 12/1967 Shaper ..... 369/139
3,541,219 A * 11/1970 Abair ..... 84/727
3,715,446 A * 2/1973 Kosinski ..... 84/727
3,983,777 A * 10/1976 Bartolini ..... 84/726
3,983,778 A * 10/1976 Bartolini ..... 84/726
4,026,178 A * 5/1977 Fuller ..... 84/726
4,140,886 A * 2/1979 Itoh ..... 369/136
4,151,776 A * 5/1979 Stich ..... 84/728
4,251,695 A * 2/1981 Ono et al. ..... 369/136
4,283,982 A * 8/1981 Armstrong ..... 84/728
4,320,681 A * 3/1982 Altilio ..... 84/726
4,353,125 A * 10/1982 Itoh et al. ..... 369/136
4,372,186 A * 2/1983 Aaroe ..... 84/725
4,378,722 A * 4/1983 Isakson ..... 84/726
4,394,830 A * 7/1983 Damiano ..... 84/726
4,408,513 A * 10/1983 Clevinger ..... 84/726
4,456,984 A * 6/1984 Van Wijk ..... 369/170
4,581,974 A * 4/1986 Fender ..... 84/725
4,581,975 A * 4/1986 Fender ..... 84/725
4,632,003 A * 12/1986 Kopp ..... 84/723
4,704,935 A * 11/1987 Franklin ..... 84/312 P
4,878,412 A * 11/1989 Resnick ..... 84/726
4,907,483 A * 3/1990 Rose et al. ..... 84/726
5,123,324 A * 6/1992 Rose et al. ..... 84/726
5,189,241 A * 2/1993 Nakamura ..... 84/728

(Continued)

*Primary Examiner*—Lincoln Donovan
*Assistant Examiner*—Christina Russell

(57) ABSTRACT

This invention is related to a magnetic pickup device for stringed musical instrument with one or more metal strings made by magnetic permeable material. The magnetic pickup device presented comprises of at least one signal picking coil for sensing of the mechanical vibrations of the strings and at least one large free shape low impedance coil for noise cancellation. The signal picking coil and the large noise picking coils are permanently connected in series in a way that the noise signals created by the two coils have opposite phase orientations and they effectively cancel each other.

3 Claims, 5 Drawing Sheets

Stringed musical instrument - Electric guitar.

U.S. PATENT DOCUMENTS

| | | | | | |
|---|---|---|---|---|---|
| 5,206,449 | A | * | 4/1993 | McClish | 84/723 |
| 5,233,123 | A | * | 8/1993 | Rose et al. | 84/726 |
| 5,290,968 | A | * | 3/1994 | Mirigliano et al. | 84/726 |
| 5,292,999 | A | * | 3/1994 | Tumura | 84/728 |
| 5,391,831 | A | * | 2/1995 | Lace | 84/726 |
| 5,401,900 | A | * | 3/1995 | Lace | 84/743 |
| 5,408,043 | A | * | 4/1995 | Lace | 84/726 |
| 5,422,432 | A | * | 6/1995 | Lace | 84/726 |
| 5,567,895 | A | * | 10/1996 | Aspri et al. | 84/294 |
| 5,789,691 | A | * | 8/1998 | Stich | 84/726 |
| 5,894,101 | A | * | 4/1999 | Damm | 84/728 |
| 5,902,934 | A | * | 5/1999 | Sprague et al. | 73/779 |
| 5,932,827 | A | * | 8/1999 | Osborne et al. | 84/726 |
| 6,040,510 | A | * | 3/2000 | Yaun | 84/294 |
| 6,253,654 | B1 | * | 7/2001 | Mercurio | 84/267 |
| 6,372,976 | B2 | * | 4/2002 | Damm | 84/723 |
| 6,441,293 | B1 | * | 8/2002 | LaBarbera | 84/723 |
| 7,135,638 | B2 | * | 11/2006 | Garrett et al. | 84/725 |
| 2001/0022129 | A1 | * | 9/2001 | Damm | 84/291 |
| 2003/0138111 | A1 | * | 7/2003 | Cheng | 381/71.7 |
| 2005/0089180 | A1 | * | 4/2005 | Saeki et al. | 381/174 |
| 2005/0109197 | A1 | * | 5/2005 | Garrett et al. | 84/726 |
| 2005/0162247 | A1 | * | 7/2005 | Beller | 335/179 |
| 2005/0285602 | A1 | * | 12/2005 | Field | 324/529 |
| 2006/0243121 | A1 | * | 11/2006 | Takabayashi | 84/731 |

* cited by examiner

Stringed musical instrument - Electric guitar.

MAGNETIC PICKUP DEVICE FOR A STRINGED MUSICAL INSTRUMENT WITH LARGE FREE SHAPE LOW IMPEDANCE COIL FOR NOISE CANCELATION

CROSS-REFFERENCE TO RELATED PATENT APPLICATION

This patent application is a continuation of the Provisional Patent application Ser. No. 60/521,231 filed on Mar. 16, 2004 by Ilitch Chiliachki.

FIELD OF THE INVENTION

This invention relates to passive electromagnetic pickup devises for stringed musical instruments with at least one metal string made by magnetic permeable material. Such musical instruments are the electric or acoustic guitars, violin, or any other stringed musical instrument with strings. In the particular embodiment the device invented produces a high quality audio electric signal with no noise caused by the surrounding space electromagnetic fields.

BACKGROUND OF THE INVENTION

One common method for amplifying the sound of a stringed musical instrument having one or more metal strings made by magnetic permeable material uses a magnetic pickup assembly positioned beneath the strings of the musical instrument. Such a magnetic pickup includes one or more signal picking coils wrapped around one or more magnetic permeable metal cores which are themselves magnetic, or which are magnetized by an adjacent permanent magnet. The magnetic field created by this permanent magnet structure does not generate an electric signal inside of the signal picking coil by itself, because the magnetic field flow, flowing through the turns of the signal picking coil, is a constant. As a result of the position of the strings near the magnet structure of the magnetic pickup, a small string area becomes magnetized. This magnetized string area has a size close to the width of the permanent magnet means exposed from the top side of the pickup. The small, magnetized string area radiates its own flow of magnetic field fluxes with an expanded pattern toward the signal picking coil. The flow of magnetic field fluxes passes through the turns of the signal picking coil. When the string does not vibrate this magnetic flow does not create an electric signal inside the signal picking coil. Picking or strumming a string causes the string to vibrate mechanically and the small, magnetized string area vibrates too. This causes an alternative magnetic field flow to pass through the turns of the signal picking coil, which generates an alternative audio electric signal that corresponds to the frequency of the string mechanical vibration. That audio electrical signal measured between the start and end terminals of the signal picking coil are available for further electronic amplification. Based on that conception theory it was found that the only magnetic pickup capable of reproducing the mechanical vibration of a string with maximum accuracy, is the single coil style magnetic pickup. There is one major undesirable disadvantage of the single coil style magnetic pickup—it picks the electromagnetic noise from the surrounding space, where the magnetic pickup is exposed. Electromagnetic noises in the space are generally produced and radiated by power transformers, power diode rectifiers, electric motors etc.

There are a few conventional methods, which use dual coil magnetic pickup assemblies to cancel that undesirable electromagnetic noise. One of these methods is called classic humbucking pickup, which includes two side-by-side positioned identical coils permanently or switchably connected in series or in parallel. Another popular method uses two stacked (one on the top of the other) identical single coil windings permanently or switchable connected in series or in parallel. These two most popular methods, generally cancel the undesirable noise but they also change the musical specter of the generated audio electric signal in one or another way. The frequency response, the phase and harmonic content of the generated audio electric signal are changed too.

OBJECTS AND ADVANTAGES OF THE INVENTION

It is a first object and advantage of this invention to keep the tonal clarity and frequency response of the single coil style magnetic pickup when it is sensing the mechanical musical string vibrations of the musical instrument.

It is a further object and advantage of this invention to provide an effective noise cancellation of the electric noise signals generated by the surrounding alternative magnetic fields.

It is an other object and advantage of this invention that a single large noise picking coil is capable of effectively canceling the noise for multiple single style signal picking coils installed on a stringed musical instrument.

SUMMARY OF THE INVENTION

The foregoing disadvantages and other problems are overcome and methods and apparatus in accordance with the embodiment of this invention realize the objects and advantages. A Magnetic pickup device for a stringed musical instrument with large free shape low impedance coil for noise cancellation generates an output audio electric signal, that strongly corresponds to the frequency, phase and harmonic content of the string mechanical musical vibrations. Also, the electric noise components contained in the generated audio electric signal are effectively cancelled.

DETAILED DESCRIPTION OF THE INVENTION

Referring to FIG. 1 through FIG. 5, a magnetic pickup device for a stringed musical instrument with large free shape low impedance coil for noise cancellation will be described.

Figure 2:
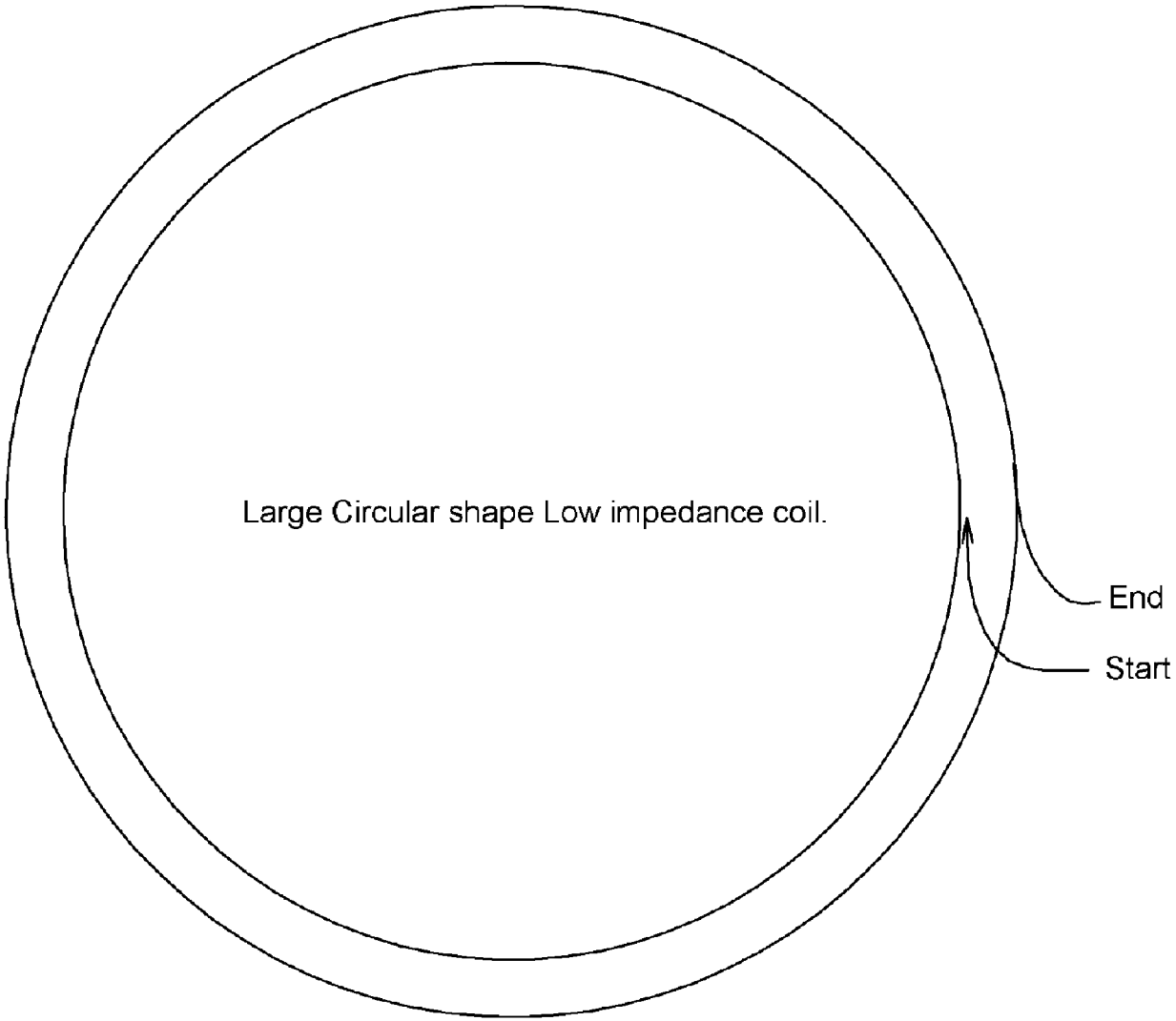
FIG. 2 is a simplified drawing of a large low impedance coil for noise cancellation with a circular shape.
Figure 3:
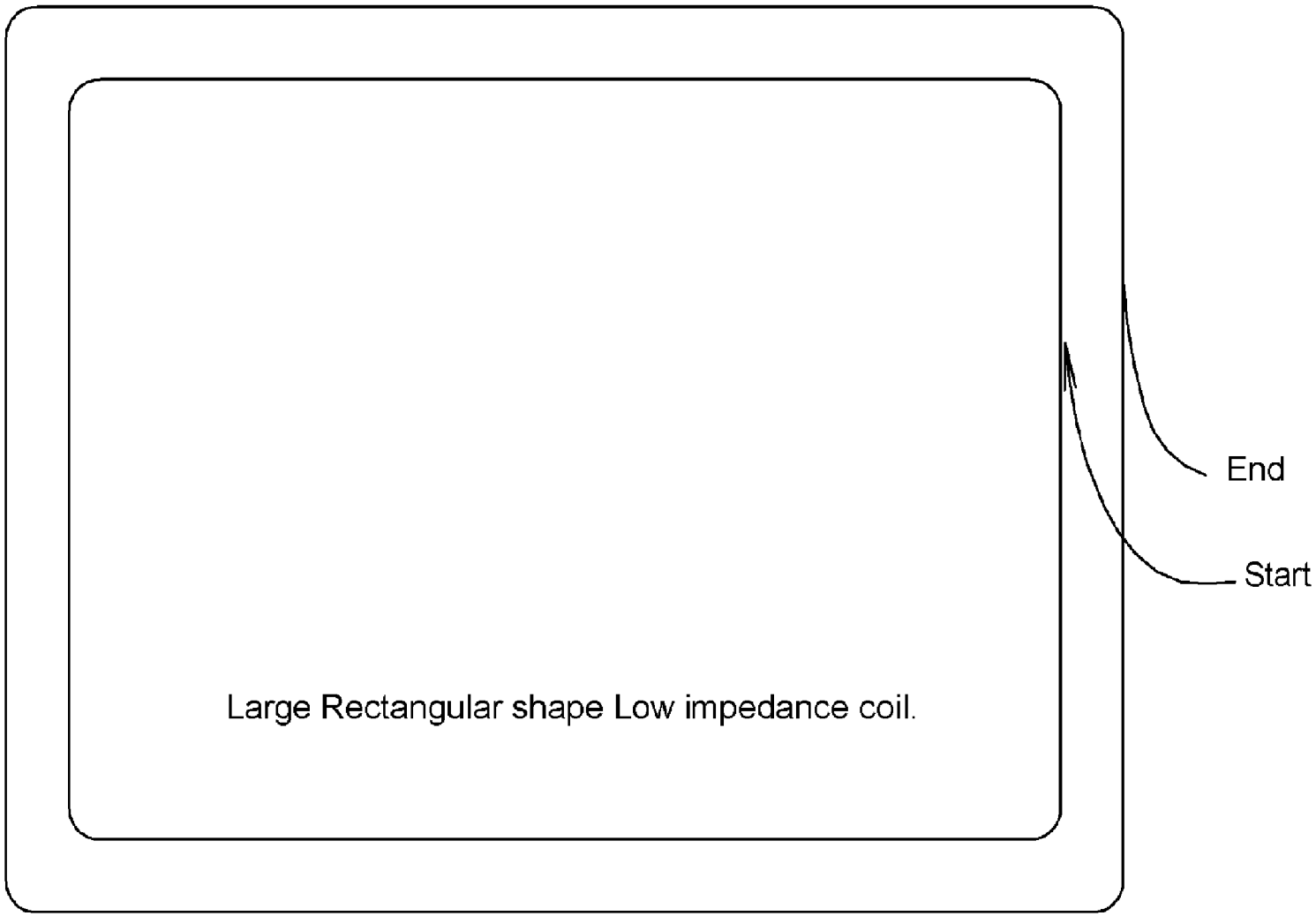
FIG. 3 is a simplified drawing of a large low impedance coil for noise cancellation with a rectangular shape.
Figure 4:
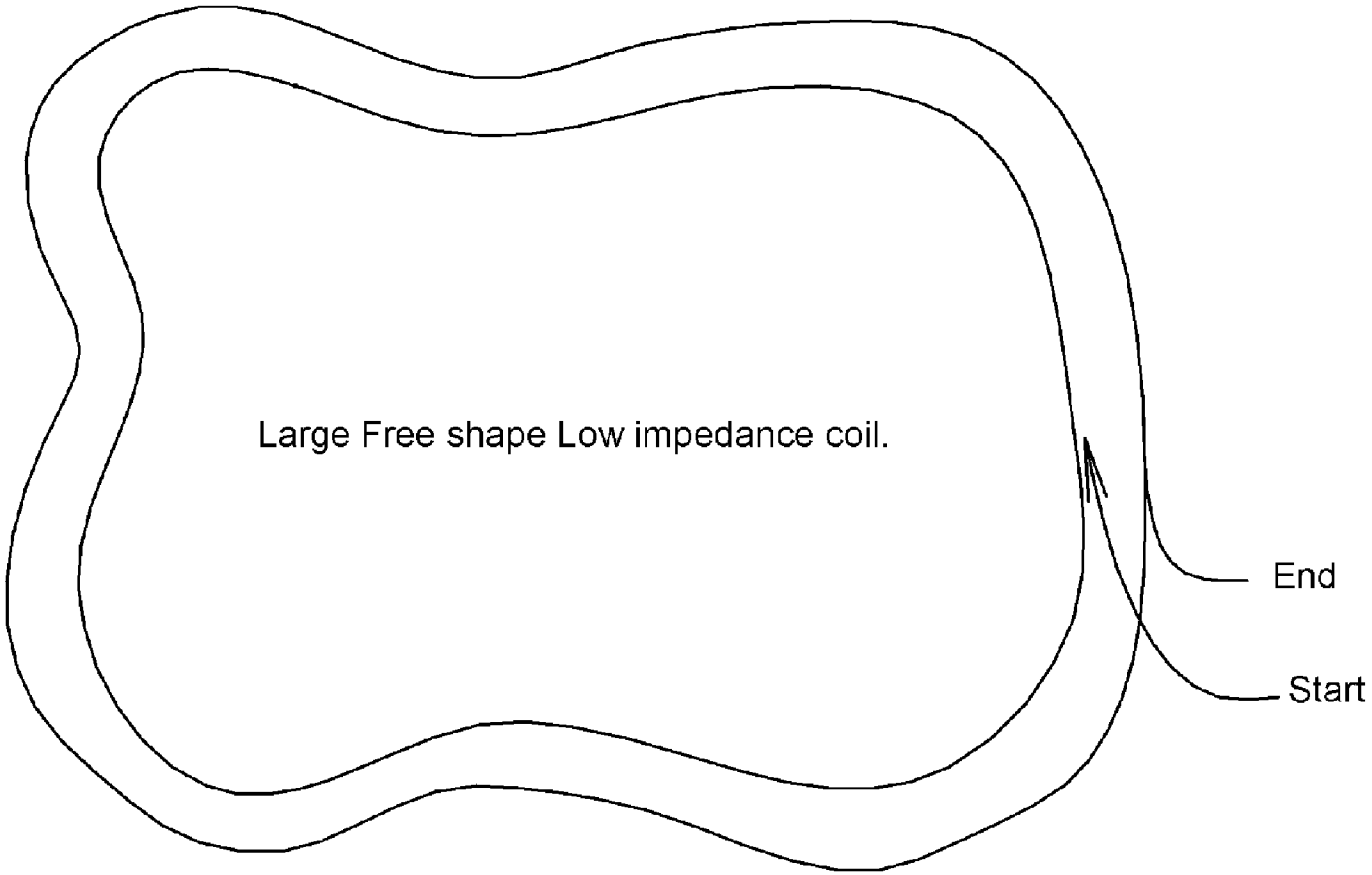
FIG. 4 is a simplified drawing of a large free shape low impedance coil for noise cancellation with a free oval rounded shape.

In general:

A large free shape low impedance coil for noise cancellation is a coil winding, that has these shapes and overall geometrical dimensions which provide a square surface area of 5 (five) or more times larger than the average square surface area of a regular single coil style signal picking coil. This requirement provides a high efficiency for electromagnetic noise picking and a low impedance (ohm resistance and reactive inductance) of the large free shape low impedance coil for noise cancellation. It is theoretically and experimentally proven that there is a ratio between the units (as a number) squares surface area and the units (as a number) linear length of any single turn that is part of a multiple turns coil. This ratio determines the capability of one unit linear length of a certain coil turn to produce a certain amount units square surface area. For small size and slotted shape (the length of the turn is significantly bigger than its width) coil turn this ratio is less than 1 (one)—practically about 0.4 to 0.8. That means: 1 (one) unit linear length is capable of producing 0.4 to 0.8 units square surface area. Increasing the geometrical size of the coil turn and making the coil shape closer to a circular shape makes this ratio bigger and bigger—practically up to 10 times. This ratio is important when a high efficiency for capturing of electromagnetic noise from the surrounding space and a low impedance (ohm resistance and reactive inductance) of the coil are desired. The large circular shape coil drawn on FIG. 2, is the optimal solution for getting the highest efficiency for an electromagnetic noise picking capability with a particular overall size coil. Practically any shape of the large free shape low impedance coil for noise cancellation that is close to the circular shape will have high electromagnetic noise picking efficiency. Some practical, useful examples of a circular shape (FIG. 2), a rectangular shape (FIG. 3) and a free shape (FIG. 4) for large free shape low impedance coil for noise cancellation are shown.

The present invention can be used with any stringed musical instrument for which an electrical amplification is need.

One preferred embodiment of the invention is particularly adapted for use with electric guitar with six strings made by magnetic permeable metal. According to FIG. 1 the musical instrument (1) has six strings (10), but more or less strings may be used on various types of musical instruments or different embodiments of a particular type of stringed musical instrument.

Figure 1:
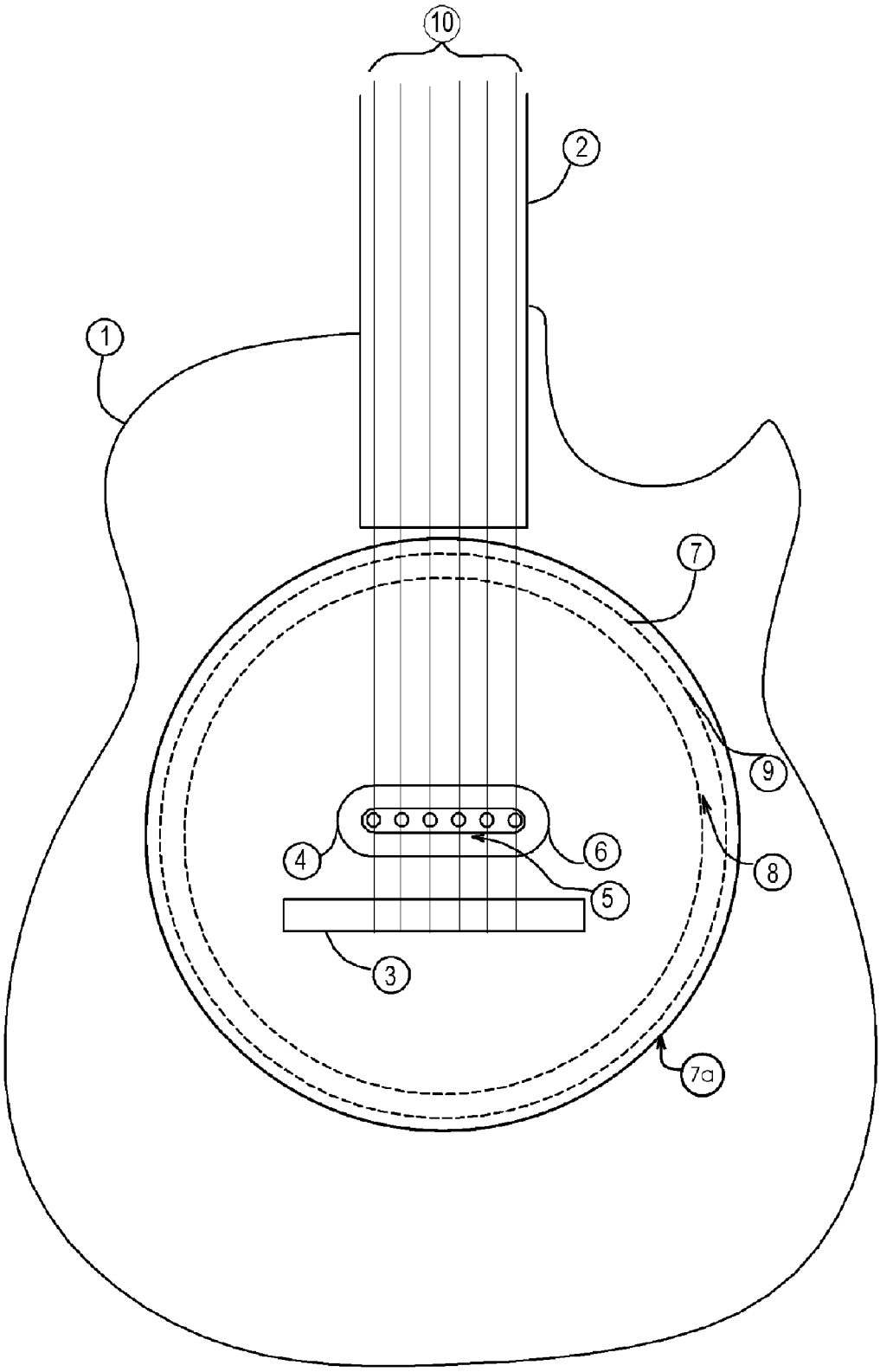
FIG. 1 represents a simplified drawing of a six-strings electric guitar with the Magnetic pickup device for a stringed musical instrument with large free shape low impedance coil for noise cancellation applied.

The electric guitar shown on FIG. 1 consists of:

1. Body
2. Neck
3. Bridge
4. Signal picking coil (Single coil style magnetic pickup)
5. Start wire terminal of the signal picking coil
6. End wire terminal of the signal picking coil
7. Large noise picking coil (Large circular shape low impedance coil for noise cancellation)

7a. Shield of the large noise picking coil

8. Start wire terminal of the large noise picking coil
9. End wire terminal of the large noise picking coil
10. Strings The strings (10) are hooked at their first end (as shown on FIG. 1) in a conventional manner to a bridge (3), and they are tightened at their second end to intonation tuners (one per each string—not shown) located at the upper end of the neck (2). In the preferred embodiment explored, the large noise picking coil (large free shape low impedance coil for noise cancellation) has a circular shape and it is flat in the vertical direction dimension. Depending on the musical instrument constructions a various styles of the winding type of the large noise picking coil are possible (i.e.e. speaker coil type style etc.). The large noise picking coil (7) is incorporated either inside of the guitar body (1), placed under an optional guitar pick-guard, or flat attached on the back surface of the guitar body (1). The magnetic pickup device invented, consists of signal picking coil (4) and a large noise picking coil (7). The two coils are preferably close positioned in a way that their axes are close to coincident and the planes of the two coils are in parallel or close to parallel. Also the approximate geometrical centers of the two coils are coincident or close to coincident. Six permanently magnetized rods, one per each string, are inserted into the signal picking coil (4). The large noise picking coil (7) is a pure air coil. The large noise picking coil (7) has no pole pieces or metal core and because of its large geometrical dimensions it is not inductively connected to the signal picking coil (4). The signal picking coil (4) and the large noise picking coil (7) are wound with the same or different gage of magnet wire. Preferably, the large noise picking coil (7) is wound with a magnet wire two or more steps toward the ticker size magnet wire gage. For example, if the signal picking coil (4) is wound with a wire gage #42, the large noise picking coil (7) is wound with a wire gage #39 or thicker. This way the large noise picking coil (7) has noticeably lower ohm resistance and reactive inductance than the ohm resistance and reactive inductance of the signal picking coil (4). Basically, the signal picking coil contains 2000 up to 20,000 turns wound with a fine wire gage between #39 and #45 magnet wire gage. Preferably, the signal picking coil (4) has 7,000 turns wound with wire gage #42. Basically, the large noise picking coil (7) has overall diameter or maximum size between 4 and 15 inches and contains 100 to 1000 turns wound with wire gage # 41 or thicker. Preferably, the large noise picking coil (7) has an overall diameter of 8 (eight) inches and contains 200 turns wound with a magnet wire gage #36. As seen, the signal picking coil (4) and large noise picking coil (7) are totally different in their shape, size and wire gage used for winding. The electric parameters (specifications) of the two coils are different too. In the preferred embodiment, the DC ohm resistance of the large noise picking coil (7) is about 250 ohms comparing to the ohm resistance of the signal picking coil (4), which is about 7,000 ohms. The reactive inductance of the large noise picking coil (7) is about 0.02 Henries, in comparison to the reactive inductance of the signal picking coil (4), which is about 2.0 Henries. It is a fact that the total ohm resistance for two coils connected in series is equal to the sum of the ohm resistance of each of the coils and that the total reactive inductance for two coils connected in series is equal to the sum of the reactive inductance of each of the coils. When the two coils (4) and (7) are wired (electrically connected) in series—together the two coils have practically the same electrical specifications that the signal picking coil (4) has by itself. That means that the audio electric signal generated by the signal picking coil (4) is not affected in any noticeable level by the large noise picking coil (7) when the two coils are in series connected. At the same time, regarding the surrounding space electromagnetic noise picking capability, the large noise picking coil (7) and the signal picking coil (4) are almost perfectly matched. They both produce the same levels of noise electric signal across their Start-End wire terminals. Preferably the two coils (4) and (7) are wound in opposite directions. Thus, the two noise electric signals created in the two coils (4) and (7), cancel each other when they are connected in series in an electric circuitry. In other words, with the invention presented, the tonal characteristic of the signal picking coil (4) is not affected in any noticeable level by the large noise picking coil (7) because of its very low ohm resistance and reactive inductance contributions.

The magnetic field, created by the permanent magnet rods inserted into the signal picking coil (4), by itself, does not generate any signal inside the signal picking coil (4), because that flow of magnetic field passing through the signal picking coil turns is constant. As a result of the close position of the string next to the permanent magnet rods, a small string area is magnetized. This magnetized, string area is with a size close to the diameter of the magnetized rods exposed. The small, magnetized string area radiates its own flow of magnetic field fluxes with an expanded pattern toward the signal picking coil (4). When the string does not vibrate this magnetic flow does not create an electric signal inside the signal picking coil. Picking or strumming a string causes the string to vibrate mechanically and the small magnetized string area vibrates too. This causes an alternative magnetic field flow to pass through the turns of the signal picking coil (4), which generates an alternative audio electric signal that corresponds to the frequency of the string mechanical vibration. An audio electric signal can be measured between the start (5) and end (6) terminals of the signal picking coil (4). At the same time the signal picking coil (4) is exposed to all noise electromagnetic fields emitted in the surrounding space. As a result, a noise electric signal is created inside the signal picking coil (4) along with the audio electric signal created by the string vibrations. The large noise picking coil (7) is exposed to the same noise components as the signal picking coil (4). Thus, a noise electric signal with the same amplitude and frequency is created inside the large noise picking coil (7). At the same time the large noise picking coil (7) practically does not respond to the string vibrations because of its large size and low number of turns contained. Connecting the signal picking coil (4) with the large noise picking coil (7) in series, results in a total cancellation of the two noise electric signals (which are identical in amplitude and opposite in phase), while the audio electric signal created mostly by the signal picking coil (4), stays not affected and with a strong amplitude. A final output audio electric signal with no noise components is being produced for further electronic amplification.

For additional noise reduction, both the signal picking coil (4) and the large noise picking coil (7) are shielded. The large noise picking coil (7) is shielded with the Shield of the large noise picking coil (7*a*), which is made by fine thickness copper or aluminum foil or other shielding technique. For protection against undesirable microphonic effect, both the signal picking coil (4) and the large noise picking coil (7) are wax or lacquer potted. Also the large noise picking coil (7) is finally firmly attached (glued) to the musical instrument body (1).

Figure 5:
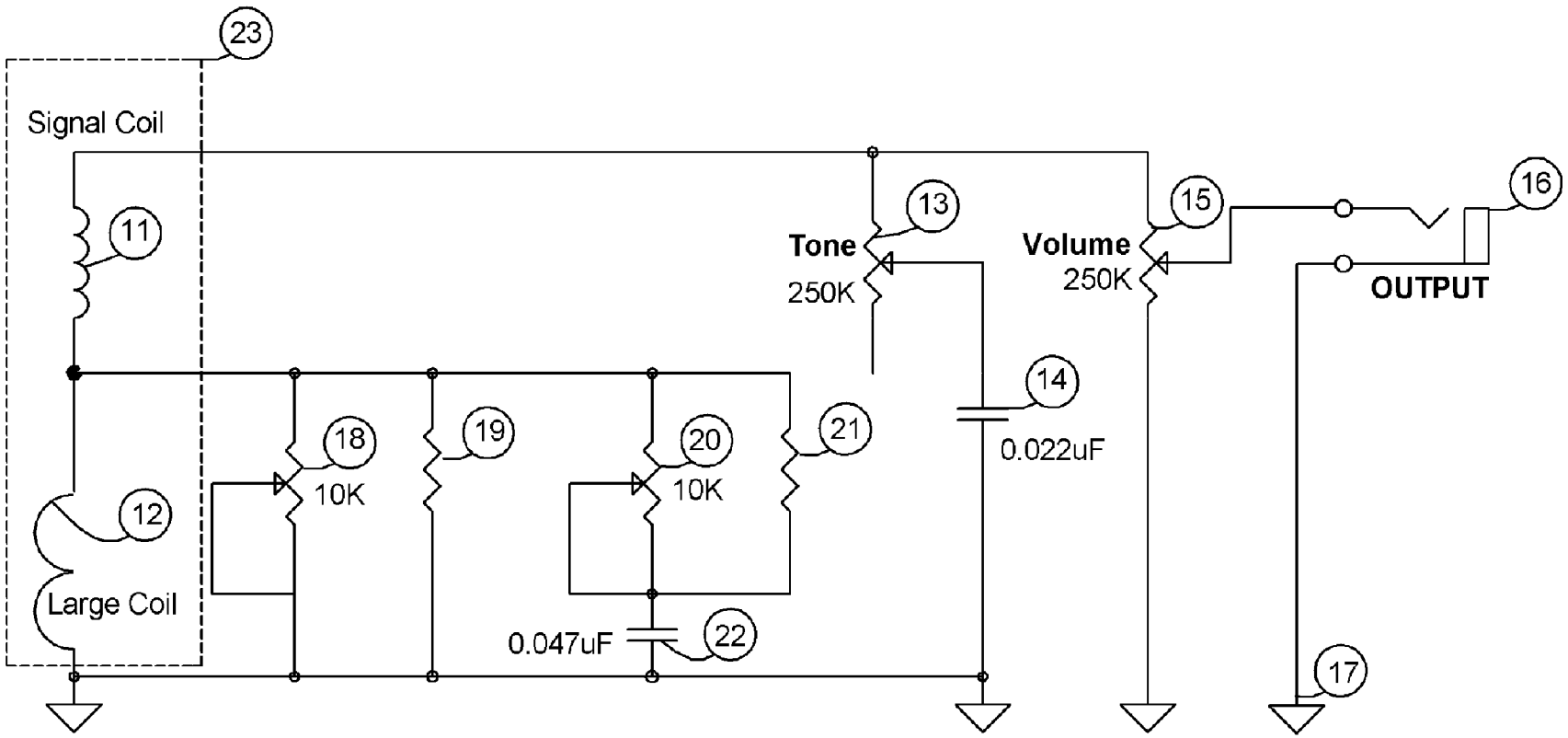
FIG. 5 is a simplified electrical circuit schematic of the Magnetic pickup device for a stringed musical instrument with large free shape low impedance coil for noise cancellation and its connection to the output jack of the musical instrument as well as its on board control devices.

A basic electric schematic of the invention, shown on FIG. 5 comprising of:

11. Signal picking coil
12. Large noise picking coil
13. Tone control potentiometer
14. Tone capacitor
15. Volume control potentiometer
16. Output jack of the musical instrument
17. Ground terminal of the musical instrument
18. Noise signal level control device
19. Additional permanent loading resistor for noise signal level adjustment
20. Noise signal frequency response control device
21. Additional permanent loading resistor for the noise signals frequency response adjustment
22. Capacitor for the noise signal frequency response adjustment
23. Magnetic pickup device for a stringed musical instrument with large free shape low impedance coil for noise cancellation The basic electric schematic on FIG. 5 demonstrates the way the Magnetic pickup device for a stringed musical instrument with large free shape low impedance coil for noise cancellation (23) is electrically connected. The musical instrument is equipped with one Volume (15) and one Tone (13) control potentiometers and an Output jack (16). Along with the standard Volume (15) and Tone (13) (250 to 1000 KOhms potentiometers), additional resistors and capacitors network is provided. The level of the created noise signal by the large noise picking coil (12) is controlled by the noise signal level control device (18), which is a trim-pot that adjusts the level of the noise electric signal in order to have an optimal noise cancellation for the entire device. The frequency response control device (20) of the noise signals is a trim-pot that controls the frequency range of the noise electric signal created by the large noise picking coil (12), in order to have an optimal noise cancellation. The Start wire terminal of the large noise picking coil (12) is electrically connected to the electrical ground terminal of the musical instrument (17). The End wire terminal of the large noise picking coil (12) is electrically connected to the Start wire terminal of the signal picking coil (11). The direction of winding of the large noise picking coil (12) is made in a way that secures the phase of the noise electric signal created inside the large noise picking coil to have an opposite phase with the noise electric signal created by the signal picking coil (11).

The above description disclosed and the drawings attached, clearly describe the Magnetic pickup device for a stringed musical instrument with large free shape low impedance coil for noise cancellation. While the invention was particularly shown and described with respect to preferred embodiment thereof, it will be understood by those skilled in the art that changes in form and details may be made therein without departing from the scope and spirit of the invention. Therefore, this invention is not to be limited by the disclosure and the drawings, but by the claims listed.

What is claimed is:

1. A magnetic pickup device for a stringed musical instrument with large free shape low impedance coil for noise cancellation comprising of:

a stringed musical instrument having strings made from magnetic permeable material, wherein said strings are magnetized to produce an alternating magnetic field caused by vibrations of said strings;

at least one single coil style magnetic pickup containing a signal picking coil. wherein said signal picking coil is responsive to said alternating magnetic field to produce a signal picking coil string electrical signal, and wherein said signal picking coil is exposed to a surrounding space electromagnetic noise to produce a signal picking coil noise electrical signal;

at least one large noise picking coil mounted within a body of said stringed musical instrument, wherein said large noise picking coil is exposed to the surrounding space electromagnetic noise to produce a large noise picking coil noise electrical signal, and wherein said large noise picking coil is not responsive to the alternating magnetic field at any noticeable level;

at least one shield electrically connected to a around terminal of said stringed musical instrument to cover and protect said large noise picking coil from a high frequency electromagnetic noise;

and a circuit network containing resistors and capacitors, wherein said circuit network is connected in electrical parallel to said large noise picking coil for fine tuning of the large noise picking coil noise electrical signal.

2. A magnetic pickup device as defined in claim 1 wherein:

said large noise picking coil is a pure air coil winding with a close to but not limited to circular shape, wherein said large noise picking coil has larger inside diameter and contains significantly lower number of turns, ohm resistance and reactive inductance compared to these same parameters of said signal picking coil.

3. A magnetic pickup device as defined in claim 1 wherein:

said circuit network further connects said signal picking coil to said large noise picking coil in electrical series, thus said signal picking coil noise electrical signal and said large noise picking coil noise electrical signal are summed with an opposite phase to cancel each other.

* * * * *